United States Patent [19]

Bearden, Jr.

[11] 4,007,110

[45] Feb. 8, 1977

[54] RESIDUA DESULFURIZATION WITH SODIUM OXIDE AND HYDROGEN

[75] Inventor: Roby Bearden, Jr., Baton Rouge, La.

[73] Assignee: Exxon Research and Engineering Company, Linden, N.J.

[22] Filed: Apr. 28, 1975

[21] Appl. No.: 571,917

[52] U.S. Cl. ..... 208/108; 208/209; 208/230; 208/251 H; 208/264; 208/289; 252/439; 252/476

[51] Int. Cl.[2] ..... C10G 13/06; B01J 27/04

[58] Field of Search ..... 208/108–112, 208/208 R, 208 M, 264, 209, 226, 289, 230, 235

[56] References Cited

UNITED STATES PATENTS

| | | | |
|---|---|---|---|
| 1,729,943 | 10/1929 | Hofsass | 260/667 |
| 1,954,478 | 4/1934 | Egloff | 208/112 |
| 3,160,580 | 12/1964 | Achenbach et al. | 208/226 |
| 3,787,315 | 1/1974 | Bearden et al. | 208/208 M |

*Primary Examiner*—Herbert Levine
*Assistant Examiner*—G. E. Schmitkons
*Attorney, Agent, or Firm*—Edward M. Corcoran

[57] ABSTRACT

Heavy petroleum oils, preferably whole crude or residua, are desulfurized and upgraded by contacting the petroleum oil with sodium oxide in the presence of hydrogen at elevated temperatures. The resulting mixture comprising desulfurized petroleum oil and a dispersion of sodium salts, primarily sodium sulfide and sodium hydroxide, is separated by conventional means and sodium oxide is regenerated from the salts.

12 Claims, 1 Drawing Figure

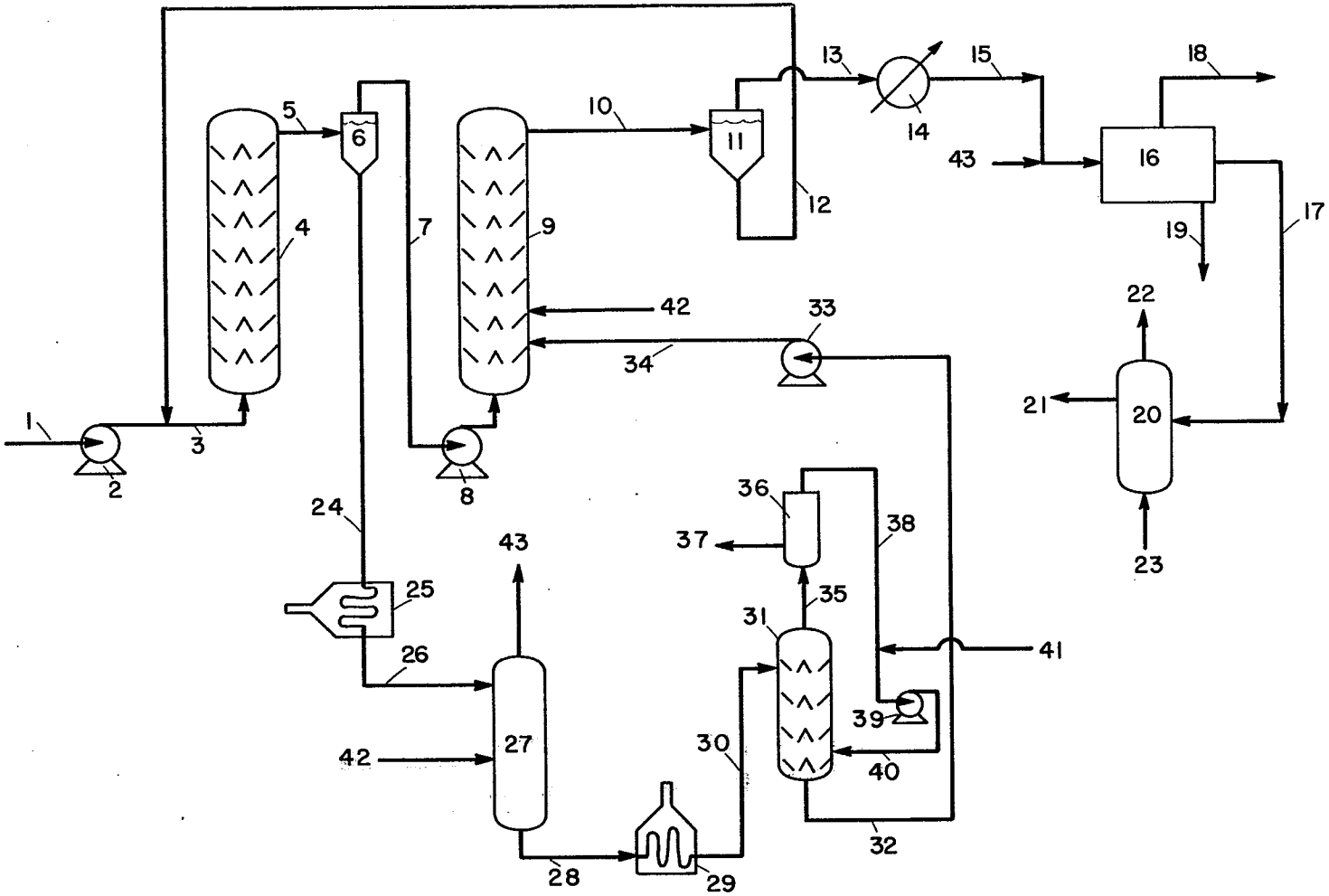
1
2
3
4
5
6
7
8
9
10
11
12
13
14
15
16
17
18
19
20
21
22
23
24
25
26
27
28
29
30
31
32
33
34
35
36
37
38
39
40
41
42
43

RESIDUA DESULFURIZATION WITH SODIUM OXIDE AND HYDROGEN

FIELD OF INVENTION

This invention relates to the desulfurization and upgrading of sulfur bearing feedstocks by contacting the feedstock with sodium oxide in the presence of low pressure hydrogen, at elevated temperatures.

DESCRIPTION OF THE PRIOR ART

The problem of air pollution, particularly with regard to sulfur oxide emissions, has been of increasing concern to refiners. As a consequence, the development of an efficient as well as an economic means for the removal of sulfur from sulfur-containing oils is a primary goal of research efforts in this industry. Presently, the most practical desulfurization process is the catalytic hydrogenation of sulfur-containing molecules in petroleum hydrocarbon feeds to effect the removal of these sulfur molecules as hydrogen sulfide. The process generally requires relatively high hydrogen pressures, e.g., from about 700 to 3000 psig and temperatures in the range of about 650° F. to 800° F., depending on the feedstocck and the degree of desulfurization.

The catalytic process is generally quite efficient in the handling of distillates but becomes more complex and expensive and less efficient as the feedstock becomes increasingly heavier, e.g., whole or topped crudes and residua. Thus, for example, a residuum feedstock is contaminated with heavy metals, e.g., nickel, vanadium, iron, and asphaltenes which tend to deposit on and deactivate the catalyst. Also, the sulfur is generally contained in high molecular weight molecules that can be broken down only with the aid of severe operating conditions, i.e., high temperature and pressure, which again promote catalyst deactivation and consumption of large amounts of hydrogen.

In the area of competitive processing schemes it has been long known that alkali metals and certain alkali metal salts exhibit desulfurization activity for residua feeds. However, the alkali metals are vastly superior to the salts in activity and in efficiency, providing for near quantitive desulfurization of feedstocks that are difficult or impossible to process with conventional catalytic hydrodesulfurization technology. For examples of residua desulfurization with sodium metal, refer to U.S. Pat. No. 3,787,315.

Alkali metal salts, notably the oxides and hydroxides, appear to have desulfurization activity dependent on the type of organic sulfur compound present. Mercaptans, aliphatic sulfides, and dibenzothiophenes, quite prevalent in residua feeds, are relatively inert to these ionic reagents. Thus, typically, only 40–60% of the sulfur is removed from atmospheric residua feeds (b.p. 650° F. +) even though large excesses of a given alkali metal salt reagent are present.

It has now been found, however, that the desulfurization activity of one of the salt reagents, sodium oxide, can be markedly improved by using the reagent in the presence of low pressure hydrogen. With hydrogen present, sodium oxide becomes fully equivalent to the highly potent sodium metal reagent for residua desulfurization. By contrast, the desulfurization activity of various other alkali and alkaline earth metal oxides and hydroxides (e.g., $Li_2O$, $Cs_2O$, CaO, BaO, CsOH, NAOH, KOH) is not improved by such use in the presence of low pressure hydrogen.

Sodium oxide plus low pressure hydrogen is of particular interest in that exceptional desulfurization activity is obtained under relatively mild conditions, and the probability for an economically feasible regeneration from the desulfurization salt products appears quite good.

Sodium oxide has been utilized in the prior art as a desulfurization reagent under various conditions. For example, sodium oxide has been suggested as an intermediate in U.S. Pat. No. 2,950,245; for use in desulfurization following halogenating agents in U.S. Pat. No. 1,973,499; for desulfurizing distillation in U.S. Pat. No. 2,770,579; and as a desulfurizing agent for the vapor phase treatment of distillate fractions in U.K. Pat. No. 967,316 (whose U.S. counterpart is U.S. Pat. No. 3,160,580).

SUMMARY OF THE INVENTION

In accordance with this invention an efficient, virtually quantitative desulfurization and feed upgrading process is presented wherein heavy hydrocarbon materials, e.g., whole or topped crudes or residua, are contacted while in the liquid phase, with sodium oxide and hydrogen at temperatures ranging from about 450° F. to about 750° F., and in the presence of low pressure hydrogen. The reaction product comprises a desulfurized, upgraded hydrocarbon feedstock and various sodium salts, e.g., primarily $Na_2S$ and NaOH, which are separated from the hydrocarbon phase by physical means such as filtration, centrifugation, or by a settling and draw-off procedure, provided that the selected treat temperature is above the salt mixture's melting point. Preferably, the salt phase is then recycled to treat fresh residua feed, to thus effect partial removal of the metals and sulfur therefrom, thereby minimizing the requirement for sodium oxide.

It has been observed that desulfurized oil quality (viscosity, Conradson Carbon content and specific gravity) is superior when sodium oxide plus low pressure hydrogen is used as opposed to sodium oxide alone. It is believed that the low pressure hydrogen interacts with certain organic radicals produced by the attack of sodium oxide on organic sulfur compounds. Thus, it may well be that these radicals or fragments, in the absence of hydrogen, would combine or polymerize to yield a product oil with virtually the same, or perhaps poorer, qualities (increased viscosity, higher API gravity) than the feedstock.

The process of this invention is generally applicable to any sulfur bearing feedstock. Thus, while the process is applicable to distillates, the process is particularly effective when utilized to desulfurize heavy hydrocarbons, e.g., those containing residual oils. Preferably, therefore, the process disclosed herein is utilized for the desulfurization of whole or topped crude oils and residua. Crude oils obtained from any area of the world such as the Middle East, e.g., Safaniya, Arabian heavy, Iranian light, Gach Saran, Kuwait, etc., as well as U.S. or Venezuelan, e.g., Laquinillas, Tia Juana, Bachequero, etc., can be desulfurized by the process of this invention. Additionally, both atmospheric residuum (boiling above about 650° F.) and vacuum residuum (boiling above about 1,050° F.) can be treated. Preferably, the feedstock is a sulfur bearing heavy hydrocarbon oil having at least about 10% of material boiling above 1,050° F., more preferably at least about 25% of material boiling above 1,050° F.

The feedstock may be directly introduced into a contacting zone for desulfurization without pretreatment. It is desirable, however, to desalt the feedstock in order to prevent NaCl contamination of the sodium salt products of the desulfurization reaction. Desalting is well known in the refining industry and may be effected by the addition of small amounts of water to the feedstock to dissolve the salt followed by the use of electrical coalescers. The oil is then dehydrated by conventional means.

If it is desired to recycle salt products from sodium oxide treating, i.e., a mixture of $Na_2S$ and NaOH, in order to thereby treat fresh feed, then the desalting and dewatering steps can be omitted. Feed contact with the $Na_2S$/NaOH mixture at 600°–700° F. not only removes a portion of the feed sulfur and metals content but also effectively removes salt, iron scale and small amounts of water from the oil.

Sodium oxide can be blended into the feedstock in a granular form ranging from powders (100+ microns) to particles (14 to 35 mesh range) or as a molten spray. The spray or powders are preferred, however, in order to maximize reaction rate and minimize the need for mechanical agitation beyond the point of initial blending of powders and feedstock. The amount of sodium oxide employed generally is a function of the sulfur content of the feedstock and the degree of deslfurization desired. Generally, about 1.0 to 3.0 moles of sodium oxide is used per mole of feed sulfur to be removed, preferably 2.0 and 3.0 and most preferably 2.5 to 2.8 moles/mole. Ratios above three based on total moles of sulfur present are to be avoided as they promote formation of a polymeric coke product and loss of the desirable liquid product oil.

Contact of the sodium oxide and the feedstock is carried out at reaction conditions designed to maintain the bulk of the feedstock, and preferably substantially all of the feedstock, in the liquid phase. Conditions may, however, be varied to provide for vapor phase contact. Reaction temperatures will generally range from about 450° F. to about 750° F., preferably about 500° F. to about 700° F., and still more preferably about 600° F. to about 700° F.

A hydrogen-containing gas is introduced into the contacting zone as either pure hydrogen (for example, from a steam reforming process) or as a diluted hydrogen gas stream (for example, that from refinery discard streams, e.g., subsequent to hydro-treating processes, gas affluent from cat cracker or reformer light ends streams, naphtha reformer recycle hydrogen streams, and the like). However, introduced hydrogen partial pressures in the contacting zone can range from about 50 to 1000 psig, preferably about 100 to 700 psig, and more preferably from about 200 to 500 psig. Hydrogen partial pressures as low as 50 psig suffice to activate the full desulfurization potential of sodium oxide. Generally, low pressure is desirable in that (1) the cost of hydrogen is less, (2) investment costs related to reactor construction are lower relative to high pressure (1000 psig+). It should be noted, however, that increasing hydrogen partial pressures allows increasing hydrogen consumption by the feedstock and, directionally, increasing product quality.

Total system pressures may vary widely and will normally vary based on the feedstock to be treated, the reaction temperature, and the desired hydrogen partial pressure. Thus, for reduced crudes the minimum total pressure will be in the range of from about 35 to 300 psig, and preferably from about 100 to 200 psig. For whole or topped crudes, total pressures may range as high as about 500 to 600 psig in order to maintain the feedstock substantially in the liquid phase.

The desulfurization step can be conducted as a batch or continuous type operation. The apparatus used in the desulfurization step is of a conventional nature and can comprise a single reactor or multiple reactors equipped with shed rows or other stationary devices to encourage contacting; orifice mixers; efficient stirring devices, such as mechanical agitators, jets of restricted internal diameter, turbomixers and the like.

The hydrocarbon feedstock and the sodium oxide can be passed through one or more reactors in concurrent, crosscurrent, or countercurrent flow, etc. It is essential that oxygen and water be excluded from the reaction zones; therefore, the reaction system is normally purged with dry nitrogen and the feedstock dried prior to introduction into the reactor. It is understood that trace amounts of water, i.e., less than about 0.5 weight percent, preferably less than about 0.1 weight percent based on total feed, can be present in the reactor. Where there are larger amounts of water, process efficiency will be lowered somewhat as a consequence of sodium oxide reacting with the water. The resulting oil dispersion is subsequently removed from the desulfurization zone and resolved by conventional means as described in more detail below.

The salt product mixture produced in sodium oxide treating is normally molten in the preferred process temperature range of 650°–700° F. Since the molten salt is not miscible with oil and is considerably more dense than the oil, separation is achieved by drawing off the molten salt layer. At treat temperatures below about 600° F., dispersions of solid salt particles in oil are obtained which can be resolved by conventional means, i.e., filtration or centrifugation.

Desulfurization salt mixtures recovered from the sodium oxide-hydrogen treating of feedstocks mentioned hereinabove are believed to have the approximate compositions noted below. If the mixture is recycled to treat fresh feed, then the $Na_2S$ concentration will increase somewhat at the expense of NaOH.

DESULFURIZATION SALT COMPOSITION

| Component | Mole % |
|---|---|
| $Na_2S$ | 25.3 |
| NaOH | 71.5 |
| $Na_2S_2O_3$ | |
| $Na_2SO_3$ | 3.2 |
| $Na_2CO_3$ | |

The mixture is also believed to contain small amounts of metal (Nickel, vanadium and iron) salts, as well as any coke that may be produced in the treating process.

Steps essential to the regeneration of sodium oxide from mixtures of sodium sulfide and sodium hydroxide are described in part in the literature. Basically, regeneration may involve converting substantially all and preferably the entire salt mixture to sodium hydroxide, converting sodium hydroxide to sodium sulfite, and then pyrolyzing the sodium sulfite to obtain sodium oxide and sulfur dioxide. These steps are presented below.

STEP A

SALT CONVERSION TO NaOH VIA THERMOLYSIS

In this method, the molten $NaOH-Na_2S$ mixture from the desulfurization step is stripped with steam above about 1200° F. to effect decomposition of sodium sulfide to sodium hydroxide and hydrogen sulfide. The procedure is described by Gossage in British Pat. No. 1176.

$$Na_2S + H_2O \rightarrow 2NaOH + H_2S$$

Hydrogen sulfide produced in the thermolysis step is converted to elemental sulfur via the Claus Process.

STEP B

SODIUM SULFITE FORMATION

Molten sodium hydroxide is sprayed into a reactor at 300°–500° F. where contact is made with steam and sulfur dioxide to produce sodium sulfite.

$$2NaOH + SO_2 \rightarrow Na_2SO_3 + H_2O$$

STEP C

SODIUM SULFITE CONVERSION TO SODIUM OXIDE

Sodium sulfite powder from Step B is fired to roughly 1700° F. where decomposition[1] occurs to yield sodium oxide and sulfur dioxide.

$$Na_2SO_3 \xrightleftharpoons{1700\ F.} Na_2O + SO_2$$

[1] F. Forster and K. Kubel, Ziet. Phys. Chem., 139, 261(1924); W. Sack, Z. Inorg. U. Allgem. Chem., 265, 255(1951).

Sodium oxide, which is molten at 1700° F., is recycled to the desulfurization reactor where it is sprayed directly into the oil or is first spray-dried and added as a finely divided solid. Sulfur dioxide is recycled to Step B for conversion of sodium hydroxide to the sulfite.

A possible alternate scheme which omits the direct conversion to sodium sulfite is as follows. Molten sodium hydroxide obtained in Step A is bubbled or contacted at 1700° F. with a small amount of sulfur dioxide, preferably no more than about 10 mole % on the total charge of NaOH, to promote the conversion of sodium hydroxide to the oxide. In effect, the sulfur dioxide serves as a catalyst for the reaction.

$$2NaOH \xrightarrow{SO_2} Na_2O + H_2O$$

The molten $Na_2O$ product or mixtures of the oxide with hydroxide and sulfite are recycled to the desulfurization zone and can be sprayed directly into the residua feed.

Further, the sodium oxide can be regenerated by converting the sodium salt product from the treating step to a feed suited to the electrolytic or carbothermal formation of sodium metal, generating sodium and then carrying out the controlled oxidation of sodium to sodium oxide as described in U.S. Pat. No. 1,685,520. One suitable feed for electrolysis is sodium chloride, which is readily prepared by treating the salt product with hydrochloric acid. The resultant sodium chloride is then decomposed to metallic sodium and chlorine in a Downs Cell, as described in U.S. Pat. No. 1,501,756, all of which is incorporated herein by reference thereto. In another scheme the sodium salt product from sodium oxide treating is converted to sodium tetrasulfide by sequential treating with hydrogen sulfide and molten sulfur. The polysulfide is then electrolyzed to yield sodium metal in an improved cell wherein the cathode and anode compartments are separated by a sodium ion permeable membrane of beta-alumina. This procedure is described in detail in U.S. Pat. Nos. 3,791,966, 3,787,315 and 3,788,978 and again, these disclosures are incorporated herein by reference thereto. For the carbothermal route to sodium metal, the sodium salt product is treated with steam and carbon dioxide to form sodium carbonate which is then decomposed thermally in the presence of carbon according to the procedure given in U.S. Pat. No. 2,162,619, also incorporated herein by reference thereto.

DESCRIPTION OF THE DRAWING

The accompanying FIGURE presents a simplified scheme for the preferred process embodiment for the desulfurization of residua feeds with sodium oxide and for the regeneration of the sodium oxide from the salt products of desulfurization.

Referring to the FIGURE, a sulfur-containing feedstock, preheated to 600°–650° F., is fed by means of line 1 to pump 2 where the discharge pressure is set to exceed the autogeneous pressure of the feedstock at the treat temperature, e.g., about 150 psig for atmospheric residua feeds at 650° F. The feed is discharged through line 3 where it contacts a molten $NaOH-Na_2S$ stream entering from line 12. The dispersion is then fed upflow in reactor 4 which contains baffles to promote continuing contact between the molten caustic and oil. Holding time in the reactor is on the order of 15 to 30 minutes. Reactor effluent exits via line 5 to settler vessel 6 to disengage the oil-molten salt mixture. The entering mixture is introduced below the level of the molten salt in the vessel thereby facilitating the oil-salt separation. Holding time in the vessel is on the order of 5 to 10 minutes at roughly 650° F.

Treated oil exits settler vessel 6 via line 7 and enters charging pump 8, where the pressure is raised to about 500 psig, and then to the sodium oxide treating reactor 9. The reactor contains baffles to promote continuing contact of oil and sodium oxide which is sprayed into the reactor in molten form from line 34. Hydrogen is introduced into reactor vessel 9 via line 42 in amounts such that the partial pressure of hydrogen in the reactor ranges between 150 and 400 psig. Holding time in the reactor is about 15 to 60 minutes and is preferably 30 minutes. Reactor inlet temperature is in the range of 600°–650° F. and the outlet temperature is on the order of 700°–750° F. The desulfurized feedstock containing dispersed sodium sulfide and sodium hydroxide leaves reactor 9 via line 10 to separator vessel 11 where the dispersion enters below and rises through a layer of molten $NaOH—Na_2S$ to promote separation of oil-salt dispersion. Molten salt removed through line 12 is recycled to contact fresh entering feed at line 3. Essentially salt-free desulfurized oil is withdrawn from vessel 11 through line 13 and cooled to about 250° F. in heat exchanger 14.

Oil exiting heat exchanger 14 via line 15 is blended with a small amount of a dilute acid such as sulfuric acid or acetic acid to decompose any organic salts of sodium as well as small entrained amounts of sodium sulfide. The acid-containing mixture enters electrostatic precipitator vessel 16 where the acidic aqueous phase and the oil phase are resolved. The aqueous phase is withdrawn through line 19 and is discarded. Excess hydrogen, light hydrocarbons and traces of $H_2S$ and water vapor are taken overhead through line 18 to separators not shown. Desulfurized, salt-free oil is withdrawn through line 17 to steam stripper vessel 20 where 250°–300° F. steam is used to remove final traces of light gases including $H_2S$. Steam enters through line 23. The steam effluent exits via line 22. Clean oil is then removed via line 21 to storage.

Molten salt removed from separator vessel 6 via line 24 enters furnace 25 where the melt temperature is raised to about 1200° F. and then is fed via line 26 to the thermolysis reactor 27 where contact is made with superheated steam entering from line 42. Steam and hydrogen sulfide obtained from sodium sulfide hydrolysis are vented through line 43. After condensing out the water, the $H_2S$ is sent to a Claus plant (not shown) for conversion to elemental sulfur. Molten sodium hydroxide exiting vessel 27 via line 28 is fed to furnace 29 where the temperature is raised to about 1800° F. and then through line 30 to the sodium oxide regeneration vessel 31.

Reactor 31 is lined internally with Carborundum's Monofrax A-2, a material resistant to corrosion by molten sodium oxide and sodium hydroxide. Molten sodium hydroxide flows downward over baffle plates and is mixed with sulfur dioxide entering through line 40. The sulfur dioxide reacts with sodium hydroxide to produce sodium sulfite, which decomposes above 1600° F. to yield sodium oxide and sulfur dioxide. Water vapor and sulfur dioxide leaving the reactor via line 35 enter condenser 36, which operates near 180° F. Sulfur dioxide solubility in water is minimal at this temperature, thus permitting the bulk of the sulfur dioxide to be recycled through line 38, compressor 39 and line 40 to reactor 31. Makeup sulfur dioxide is added via line 41 to maintain a $SO_2$/NaOH mole ratio of from 0.05 to 0.1. Contact time, normally 1 to 2 hours, at 1700° F., is adjusted to provide an effluent stream containing at least 60 wt.% and preferably 80 wt.% sodium oxide. The molten sodium oxide-sodium hydroxide stream is drawn from reactor 31 via line 32, pressurized to about 500 psig in compressor 33, and then fed back into reactor 9 as a molten spray entering through line 34.

DESCRIPTION OF PREFERRED EMBODIMENTS

A. Desulfurization of Residua

The reactor consists of a standard, one liter Paar autoclave, which is constructed of Monel Steel. Two modifications may be made, however. An oversized turbine blade stirrer head can be substituted for the standard item to aid in lifting and dispersing the reagent. The reactor head contains the usual openings and fittings for measurement of pressure and temperature and for the addition of gases.

In a series of test runs, the reactor was charged at room temperature with the desired quantity of sulfur-containing oil and desulfurization reagent, usually in powder or granular form. The reactor was sealed and thoroughly flushed with $H_2$. Usually, 100 psig of the $H_2$ was present when heatup began. The reactor temperature was brought to run temperature as quickly as possible with stirring (approximately 30 minutes) and the $H_2$ pressure was adjusted to the desired run value. For runs without hydrogen, nitrogen was used to purge the reactor prior to heatup.

The yield of gaseous products, comprising materials lighter than or the same weight as pentane, was determined by cooling the reactor to room temperature, venting the gases through a wet test flow meter to determine volume, and then carrying out a component analysis upon representative sample by mass spectrometry.

Coke formed in the desulfurization reaction was normally isolated with the desulfurization salt products and was recovered by dissolving the salts in water.

Without exception, the combined coke and $C_5$- gas yield never amounted to more than 1.0 wt.% of the feed and usually was less than 0.5 wt.% of the feed. Therefore, coke and gas yields are not reported in the examples which follow. Also, desulfurized oil recoveries were essentially quantitatives in all examples.

B. Separation of the Oil and Salt Phases

After the designed reaction period was completed, the reactor contents were heated to 650° F. for 10 minutes, except in the runs where the reaction temperature selected was 650° F. or above, in which case the reactor and contents were cooled directly to about 200°–250° F., and filtered through a number 2 grade Whatman paper to achieve separation of salts and oil. The salt cake was subsequently washed free of adhering oil with toluene, dried under vacuum and stored under nitrogen. The product oil, including small amounts recovered from the toluene wash of salt products, was treated with acetic acid to remove traces of oil soluble alkali metal salts such as the mercaptides, and again filtered prior to the carrying out of routine product inspections. The acetic acid step consisted of treating a toluene diluted sample of the oil with 1 wt.% glacial acetic acid, based on the weight of the oil, for about 30 minutes at 180° F., vacuum stripping to remove toluene and excess acetic acid, and then hot filtering to separate oil from traces of alkali metal acetates.

C. Oil Product Analyses

Oil products on each run were analyzed not only for sulfur content, but also for changes in metals content and general physical properties, such as API gravity, viscosity and asphaltene content.

D. Sulfur Containing Feedstocks

While this invention is generally applicable to heavy crudes and residua feeds, including both the 650+° F. and 1030+° F. fractions of feeds from Africa, North and South America and the Middle East, the inspections for the specific feedstocks which are used in the examples are as follows:

| Feed Designation | Safaniya | Tia Juana | Kuwait |
|---|---|---|---|
| API Gravity | 14.4 | 15.0 | 7.8 |
| Sulfur, Wt.% | 3.91 | 2.2 | 5.2 |
| Nitrogen, Wt.% | 0.26 | 0.35 | |
| Carbon, Wt.% | 84.42 | 86.19 | |
| Hydrogen, Wt.% | 11.14 | 11.38 | |
| Oxygen, Wt.% | 0.27 | 0.30 | |
| Conradson Carbon, Wt.% | 11.82 | 11.60 | 15 |
| Metals, ppm | | | |
| Ni | 20 | 34 | 23 |
| V | 77 | 273 | 75 |
| Fe | 4 | — | |
| Viscosity | | | |
| VSF at 122° F. | 235 | 373 | — |
| 140° F. | 131 | 193 | — |

-continued

| Feed Designation | Safaniya | Tia Juana | Kuwait |
|---|---|---|---|
| Pour Point, ° F. | 33 | 35 | — |
| Naphtha Insolubles, Wt.% | 7 | 7.5 | 8 |
| R.I. at 67° C. | | | |
| Flash Point, ° F. | 318 | 315 | 360 |

Table I below shows the desulfurization results of treating various feedstocks with various reagents, including sodium oxide. Generally, these reagents exhibited moderate to poor desulfurization activity with residuum type feeds. As noted previously, sodium metal (Example 8) was an excellent desulfurization reagent and was clearly far superior to sodium oxide (Example 7) under comparable test conditions.

TABLE 1

NON-CATALYTIC CHEMICAL DESULFURIZATION WITHOUT HYDROGEN

| Example | Reagent | Mole Ratio of reagent to Feed Sulfur | Feed | Treat Conditions Time, Hrs. | Temp., ° F. | Press, psig | % Desulf. |
|---|---|---|---|---|---|---|---|
| 1 | KOH | 1.3 | Kuwait | 1 | 700 | 170 | 50 |
| 2 | CsOH | 1.0 | Oxidized West Texas | 4 | 500 | 40 | 11 |
| 3 | $K_2CO_3$ | 4.5 | West Texas | 4 | 725 | 135 | 19 |
| 4 | CaO | 2.8 | Kuwait | 4 | 600 | atm. | 10 |
| 5 | LiOH | 12.0 | Kuwait | 3 | 600 | atm. | <10 |
| 6 | NaOH | 6.0 | Kuwait | 3 | 600 | atm. | 10–15 |
| 7 | $Na_2O$ | 2.5 | Safaniya Atmos. | 1.3 | 650 | ~40 | 58 |
| 8 | Na | 2.5 | Safaniya Atmos. | 1 | 650 | ~50 | 90 |

Example 6 shows that although NaOH is relatively inactive for desulfurization, it can be used to remove up to about 15% by weight of residua sulfur at approximately 600° F., and perhaps greater amounts at somewhat higher treating temperatures, i.e., 650°–700° F. Thus, when mixtures of NaOH and $Na_2S$ from sodium oxide treatment are recycled to treat fresh feed, the net effect is to lower the requirement for sodium oxide in the second stage by some 10 to 15%.

Table 2 below shows the results of employing relatively low pressure hydrogen with several of the reagents employed in Examples 1–8. A comparison of the results shown in Tables 1 and 2 reveals that, with but one exception, low pressure hydrogen provided no beneficial effect on the use of the reagents to desulfurize the feedstock. Thus, calcium oxide without hydrogen (Examples 4, Table 1) gave virtually the same degree of desulfurization as calcium oxide with hydrogen (Example 11, Table 2). The same is true for potassium hydroxide (Examples 13 and 14, Table 2). Thus, it was particularly surprising to find that sodium oxide (Example 10, Table 2) does exhibit a rapid, favorable response to low pressure hydrogen, and the response makes sodium oxide-hydrogen virtually equivalent to sodium-hydrogen systems (Example 9) for desulfurization.

TABLE 2

NON-CATALYTIC CHEMICAL DESULFURIZATION WITH HYDROGEN PRESENT
(Safaniya Atmospheric Residuum Feed)

| Example | Reagent | Mole Ratio of Reagent to Sulfur* | Treat Conditions Time, Hrs. | Temp., ° F. | Hydrogen, psig | % Desulfurization |
|---|---|---|---|---|---|---|
| 9 | Na | 2.2 | 1.0 | 650 | ~200 | 93 |
| 10 | $Na_2O$ | 2.4 | 1.5 | 650 | ~200 | 85 |
| 11 | CaO | 1.0 | 1.0 | 700 | ~820 | <10 |
| 12 | BaO | 1.0 | 1.0 | 700 | ~725 | ~17 |
| 13 | KOH | 0.2 | 0.5 | 720 | 0 | 20 |
| 14 | KOH | 0.2 | 0.5 | 720 | 200 | 26 |
| 15 | $Li_2O$ | 1.6 | 1.0 | 650 | 200 | <10 |
| 16 | $Cs_2O$ | 1.2 | 1.0 | 650 | 200 | <10 |

*Total organic sulfur in feed

In Table 3 it can be seen that product quality is much better for residua treated with sodium oxide plus low pressure hydrogen (Example 10) than the sodium oxide alone (Example 7). Specifically, the Conradson carbon content is lower and API gravity is higher when low pressure hydrogen is present. Also, the coke yield is much lower than obtained with sodium oxide alone.

TABLE 3

INFLUENCE OF HYDROGEN ON OIL PRODUCT QUALITY
(Sodium Oxide Studies with Safaniya Residuum)

| Example No. | 7 | 10 |
|---|---|---|
| Test Conditions | | |
| Mole Ratio, $Na_2O$/Feed Sulfur | 2.5 | 2.4 |
| Temperature, °F. | 650 | 650 |
| Time, Hrs. | 1.3 | 1.5 |
| Hydrogen, psig | — | ~200 |
| Liquid Product Inspection | | |
| Sulfur | 1.6 | 0.6 |
| Conradson Carbon | 7.5 | 5.5 |
| Metals, ppm | | |
| Ni | 29 | 27 |
| V | 28 | 35 |
| Fe | 6 | 4 |
| API Gravity | 16.9 | 20 |
| Coke Yield, Wt.% on Feed | 3.1 | 0.7 |

What is claimed is:

1. A process for desulfurizing a sulfur-containing heavy hydrocarbon feedstock containing at least about 10 weight % materials boiling above about 1050° F, which comprises contacting said hydrocarbon feedstock, substantially in a liquid phase, with sodium oxide in a conversion zone, in the presence of hydrogen maintained at a pressure of between about 50 and 1000 psig, so that the sulfur content of said heavy hydrocarbon feedstock is substantially reduced.

2. The process of claim 1 wherein said conversion zone is maintained at a temperature of between about 450° to 750° F.

3. The process of claim 1 wherein the temperature in the conversion zone ranges from about 500° F to about 700° F.

4. The process of claim 1 wherein said sodium oxide to feed sulfur mole ratio ranges from about 2.0 to 3.0.

5. The process of claim 1 wherein said hydrogen is maintained in said conversion zone at a pressure of between about 200 and 500 psig.

6. A process for desulfurizing a sulfur-containing hydrocarbon feedstock selected from the group consisting of whole or topped crude oils and residua which comprises a. contacting said feedstock in a conversion zone with sodium oxide in the presence of hydrogen maintained at a pressure of between about 50 and 1000 psig, said feedstock being maintained substantially in the liquid phase, thereby forming an oil-salt mixture, said salt comprising sodium sulfide and sodium hydroxide;

b. separating said oil-salt mixture, and recovering the salt portion thereof;

c. converting said sodium sulfide to sodium hydroxide;

d. converting said sodium hydroxide to sodium sulfite by reaction with aqueous sulfur dioxide; and e. pyrolizing said sodium sulfite to produce sulfur dioxide and sodium oxide, for recycling to said step *a*.

7. The process of claim 6 wherein said conversion zone is maintained at a temperature of between about 450° and 750° F.

8. The process of claim 6 wherein said conversion zone is maintained at a hydrogen pressure of between about 200 and 500 psig.

9. The process of claim 6 wherein the mole ratio of said sodium oxide to feed sulfur is maintained in the range of from about 1.0 to about 3.0.

10. The process of claim 6 wherein the temperature in the conversion zone ranges from about 500° F to about 700° F.

11. The process of claim 10 wherein the feedstock contains at least about 25 weight % of material boiling above 1050° F.

12. The process of claim 3 wherein the feedstock contains at least about 25 weight % of material boiling above 1050° F.

* * * * *